US006837319B2

(12) United States Patent
Dvorak et al.

(10) Patent No.: US 6,837,319 B2
(45) Date of Patent: Jan. 4, 2005

(54) CONTROL SYSTEM FOR, AND A METHOD OF, DISENGAGING A HYDRAULICALLY-DRIVEN IMPLEMENT FROM A WORK MACHINE

(75) Inventors: Paul A. Dvorak, Sanford, NC (US); Mark A. Sporer, Raleigh, NC (US); James M. Bell, Metamora, IL (US)

(73) Assignee: Caterpillar S.A.R.L., Geneva ( * ) Notice: Subject to any disclaimer, the term of this patent is extended or adjusted under 35 U.S.C. 154(b) by 21 days.

(21) Appl. No.: 10/207,289

(22) Filed: Jul. 29, 2002

(65) Prior Publication Data

US 2004/0016586 A1 Jan. 29, 2004

(51) Int. Cl.[7] ..... B60K 25/00; B66F 9/22

(52) U.S. Cl. ..... 180/53.4; 180/324; 60/468; 414/723

(58) Field of Search ..... 180/273, 53.4, 180/315, 324, 333; 414/686, 723, 724, 912; 60/468, 494; 91/465

(56) References Cited

U.S. PATENT DOCUMENTS

| | | | | |
|---|---|---|---|---|
| 3,904,167 A | | 9/1975 | Touch et al. | |
| 4,325,434 A | | 4/1982 | Roberts | |
| 4,413,806 A | * | 11/1983 | Anderson | 251/340 |
| 4,508,014 A | | 4/1985 | Shoff | |
| 4,577,712 A | * | 3/1986 | Foote et al. | 180/53.4 |
| 4,596,271 A | | 6/1986 | Brundage | |
| 4,824,319 A | * | 4/1989 | Arnold | 414/723 |
| 5,048,294 A | * | 9/1991 | Oshina et al. | 60/468 |
| 5,052,511 A | * | 10/1991 | Hunt | 180/305 |
| 5,106,543 A | | 4/1992 | Dodds | |
| 5,110,254 A | * | 5/1992 | Aubrey | 414/723 |
| 5,146,943 A | | 9/1992 | Bert | |
| 5,148,792 A | | 9/1992 | Tuckey | |
| 5,269,141 A | | 12/1993 | Burch et al. | |
| 5,277,027 A | | 1/1994 | Aoyagi et al. | |
| 5,313,983 A | | 5/1994 | Rost et al. | |
| 5,522,301 A | | 6/1996 | Roth et al. | |
| 5,751,599 A | | 5/1998 | Bortnik et al. | |
| 5,832,996 A | | 11/1998 | Carmody et al. | |
| 5,893,387 A | | 4/1999 | Paterson et al. | |
| 5,996,632 A | | 12/1999 | Vogel et al. | |
| 6,032,537 A | | 3/2000 | McLaren | |
| 6,032,638 A | * | 3/2000 | Kato | 123/295 |
| 6,186,260 B1 | * | 2/2001 | Schenck et al. | 180/273 |
| 6,209,321 B1 | | 4/2001 | Ikari | |
| 6,226,582 B1 | | 5/2001 | Adsett et al. | |
| 6,229,447 B1 | | 5/2001 | Hand et al. | |
| 6,266,960 B1 | * | 7/2001 | Bibb et al. | 60/486 |
| RE37,339 E | * | 8/2001 | Horton | 37/468 |
| 6,279,593 B1 | | 8/2001 | Sheppard | |
| 6,308,516 B1 | | 10/2001 | Kamada | |
| 6,336,325 B1 | * | 1/2002 | Gluck et al. | 60/468 |
| 6,352,428 B1 | | 3/2002 | Uribetxebarria et al. | |

* cited by examiner

*Primary Examiner*—David R. Dunn
(74) *Attorney, Agent, or Firm*—Leill & McNeil; Keith P Roberson; Diana L Charlton

(57) ABSTRACT

A work machine is operably coupled to an interchangeable hydraulically-driven implement via at least one hydraulic line. When changing the hydraulically-driven implement, high pressure trapped within the hydraulic line may cause difficulties in disengaging the attached hydraulically-driven implement from a body of the work machine. The present invention relieves the pressure in the hydraulic line by energizing at least one electronically controlled valve while an engine of the work machine is inactive. The valve is operably coupled to an electrical actuator and is moveable between, at least, a first position and a second position. When the valve is in the first position, the hydraulic line is fluidly connected to a low pressure line. A control system includes a pressure release controller that is operably coupled to energize the electrical actuator and move the valve to the first position when the engine is inactive.

19 Claims, 3 Drawing Sheets

CONTROL SYSTEM FOR, AND A METHOD OF, DISENGAGING A HYDRAULICALLY-DRIVEN IMPLEMENT FROM A WORK MACHINE

TECHNICAL FIELD

The present invention relates generally to work machines including interchangeable hydraulically-driven implements, and more specifically to control systems for disengaging the hydraulically-driven implements from the work machine.

BACKGROUND

Work machines can often include interchangeable hydraulically-driven implements. By altering the hydraulically-driven implement attached to the work machine, the function of the work machine can also be altered. For instance, various implements, including but not limited to, an auger, a bucket and a pickup broom, can be attached to a skid steer loader. When the auger is attached to the skid steer loader, the skid steer loader can be used for drilling holes; whereas, when the pickup broom is attached to the skid steer loader, the skid steer loader can be used for removing and dumping material. However, in order for the work machine to include interchangeable implements, there must be a method of disengaging the hydraulically-driven implement from the work machine.

Engineers have long known that opening a closed hydraulic system, such as a hydraulic system connecting the hydraulically-driven implement to the work machine body, can be difficult, and often undesirable, when high pressure is trapped within the system. Over the years, engineers have developed electrical and mechanical methods for overcoming these problems. For instance, there are apparatuses, such as that shown in U.S. Pat. No. 6,032,537, issued to McLaren, on Mar. 7, 2000, that detect high pressure within a hydraulic system and bleed the high pressure to a low pressure reservoir prior to opening the hydraulic system. Although these pressure relieving methods have found use in various situations, many of the methods have not been applied to aid in the disengaging of an interchangeable hydraulically-driven implement from a work machine, such as a skid steer loader.

The hydraulically-driven implement is generally attached to the body of a skid steer loader by two hydraulic lines connected to two attachment ports of the skid steer loader. Two valves included within the work machine control the flow of hydraulic fluid to and from the implement. In order to operate the implement in one direction, a first valve will be moved to a position that allows high pressure hydraulic fluid to flow through the first port and the connected hydraulic line. A second valve will connect the second hydraulic line to the low pressure reservoir. Thus, high pressure fluid will flow through the first hydraulic line, do work within the implement, and flow out the second hydraulic line to the low pressure reservoir. In order to move the hydraulically-driven implement in a second direction, the second valve will connect the second hydraulic line to the source of high pressure fluid, while the first valve will connect the first hydraulic line to the low pressure reservoir. Thus, the implement will move in a second direction.

When the engine of the skid steer loader is de-activated, high pressure fluid flowing through the implement may remain within one or both of the hydraulic lines. Thus, when the operator attempts to detach the implement from the skid steer loader, the trapped high pressure fluid can make it difficult to disconnect the hydraulic lines from the attachment ports via quick disconnectors. Sometimes, operators may resort to unsafe and/or destructive techniques to disconnect the hydraulic lines, such as prying apart the disconnectors with work tools. The difficulty in disconnecting the implement may become burdensome on the operator when changing implements. Moreover, if the operator de-activates the implement when it is in a position which requires pressurized fluid to remain, the implement may react to the release of pressure by unexpectedly moving. Thus, if the operator is disonnecting the hydraulic lines from the attachment ports when the pressure is released, the operator may be at risk for injury.

The present invention is directed to overcoming one or more of the problems set forth above.

SUMMARY OF THE INVENTION

In one aspect of the present invention, a work machine includes a hydraulically-driven implement operably coupled to a work machine body via at least one hydraulic line. At least one valve is operably coupled to an electrical actuator and is moveable between, at least, a first and a second position. A pressure release controller is operably coupled to energize the electrical actuator and move the valve to the first position when the pressure controller is in a first position and an engine of the work machine is inactive. When the valve is in the first position, the hydraulic line is fluidly connected to a low pressure line. When the valve is in the second position, the hydraulic line is closed to the low pressure line.

In another aspect of the present invention, a control system for a work machine includes at least one valve operably coupled to an electrical actuator. The valve is moveable between, at least, a first position and a second position. A pressure release controller is operably coupled to energize the electrical actuator and to move the valve to the first position when an engine is inactive.

In still another aspect of the present invention, a hydraulically-driven implement is disengaged from a work machine body by relieving pressure in at least one hydraulic line extending between the work machine body and the hydraulically-driven implement. At least one electronically controlled valve is energized while an engine of the work machine is inactive.

DETAILED DESCRIPTION

Figure 1:
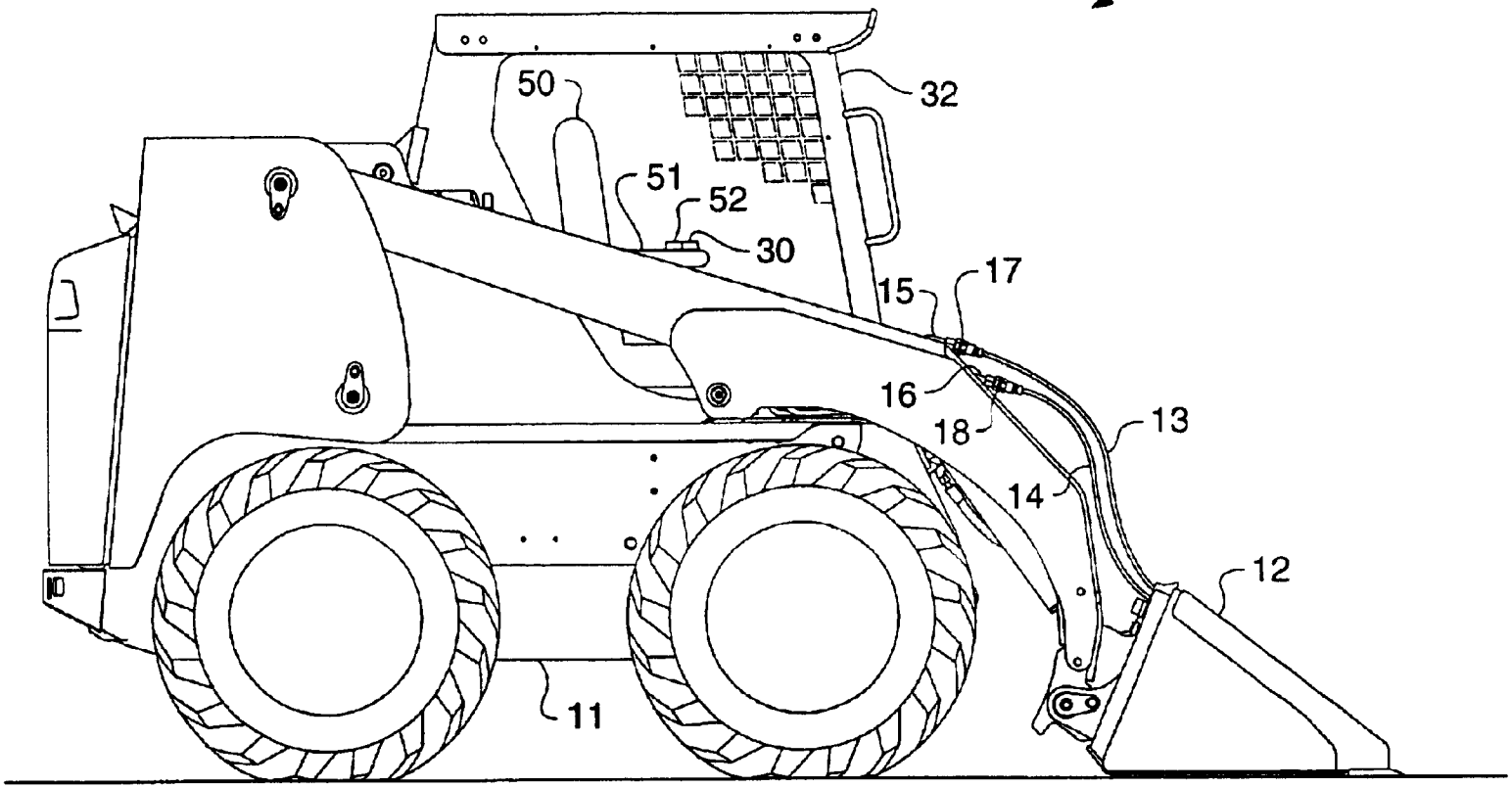
FIG. 1 is a side view of a work machine including a hydraulically-driven implement, according to the present invention.

Referring to FIG. 1, there is shown a side view of a work machine according to the present invention. Although the work machine 10 is preferably a skid steer loader, it should be appreciated that the work machine 10 could be any type of work machine 10 to and from which interchangeable hydraulically-driven implements can be attached and detached. Further, although the interchangeable hydraulically-driven implement is illustrated as a broom 12, it should be appreciated that various interchangeable hydraulically-driven implements, including but not limited to augers, cold planers, buckets and trenchers, could be attached to the work machine body 11. The broom 12 is operably coupled to a work machine body 11 via a first hydraulic line 13 and a second hydraulic line 14. Although the present invention is illustrated as including two hydraulic lines 13 and 14, it should be appreciated that there could one or any number of hydraulic lines connecting the broom 12 to the work machine body 11. The first hydraulic line 13 is preferably connected to a first attachment port 15 of the skid steer loader 10 via a first quick disconnector 17. The second hydraulic line 14 is preferably connected to a second attachment port 16 of the skid steer loader 10 via a second quick disconnector 18. Those skilled in the art should appreciate that the quick disconnectors 17 and 18 are generally two-piece devices for attaching and detaching fluid lines.

An operator's seat 50 is positioned within a cab 32 of the skid steer loader 10. An arm bar 51 including a safety bar (not shown in side view) that rests across the operator's lap when in a downward position is preferably moveably attached to the operator's seat 50. A pressure release controller 30 is also preferably positioned within the cab 32. Although the pressure release controller 30 is illustrated as attached to a portion of the arm bar 51 of the operator's seat 50, it should be appreciated that the pressure release controller 30 could be positioned at various points within the cab 32 without departing from the invention. The pressure release controller 30 is preferably positioned within the cab 32 so that the operator can avoid unexpected movement of the implement 12 caused by the release of pressure from the hydraulic lines 13 and 14 when the pressure release controller 30 is activated. However, the pressure release controller 30 could be attached to the work machine body 11 outside of the cab 32 at a position far enough from the implement 12 as to avoid any unexpected movement, such as behind the skid steer loader 10.

Figure 2:
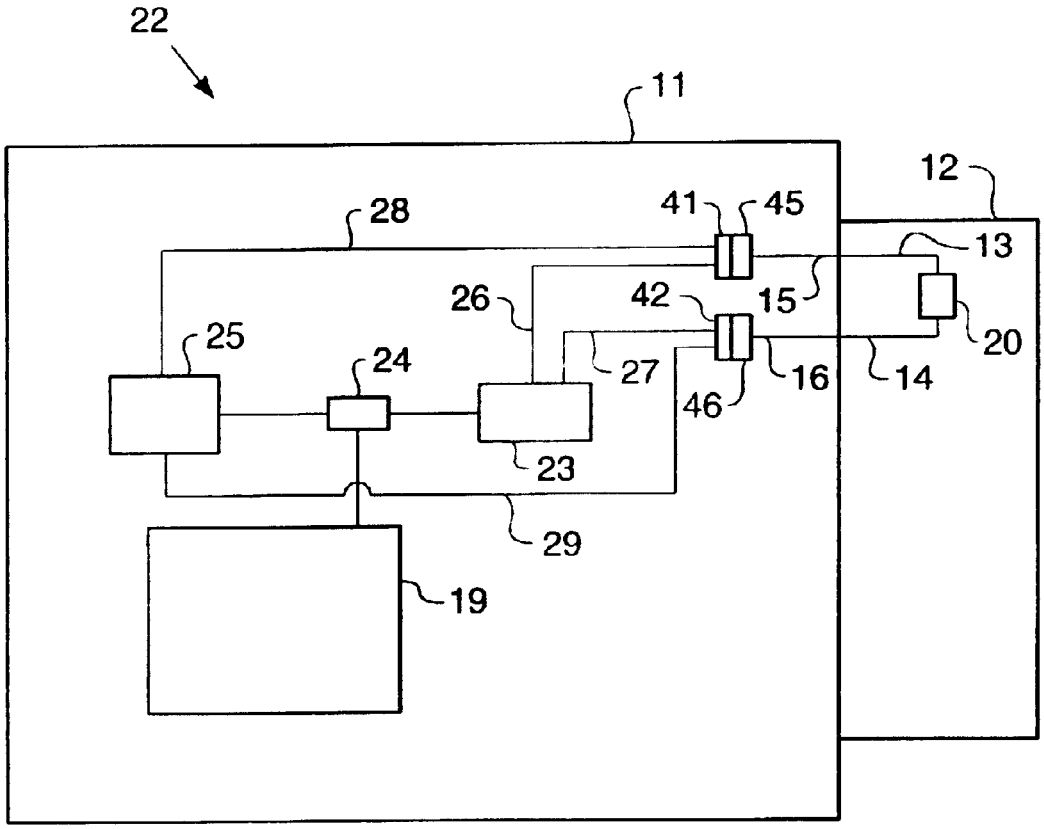
FIG. 2 is a schematic representation of a hydraulic system of the work machine of FIG. 1.

Referring to FIG. 2, there is shown a hydraulic system 22 included within the work machine 10 of FIG. 1. The hydraulic system 22 includes a low pressure reservoir 23 in which low pressure hydraulic fluid is stored. Fluid is pumped from the low pressure reservoir 23 via a high pressure pump 24 and delivered to a source of high pressure 25. The high pressure pump 24 is operably coupled and driven by an engine 19 attached to the work machine body 11. The source of high pressure 25 is in fluid communication with the first attachment port 15 and the second attachment port 16 via a first supply line 28 and a second supply line 29, respectively. The first attachment port 15 and the second attachment port 16 are also preferably in fluid communication with the low pressure reservoir 23 via a first drain line 26 and a second drain line 27, respectively. The first hydraulic line 13 and the second hydraulic line 14 are fluidly connected to the first attachment port 15 and the second attachment port 16.

A first valve 45 and a second valve 46 control the flow of hydraulic fluid to and from the hydraulically driven implement 12 via the first hydraulic line 13 and the second hydraulic line 14, respectively. Preferably, a mechanical device 20 is at least partially positioned within the first hydraulic line 13 and the second hydraulic line 14. The mechanical device 20 uses the energy created by the high pressure hydraulic fluid to move the broom 12. When high pressure hydraulic fluid flows via the first valve 45 into the first hydraulic line 13 and is drained from the second hydraulic line 14 via the second valve 46, the hydraulic fluid acting on the mechanical device 20 will cause the broom 12 to rotate in a first direction. When the hydraulic fluid flows into the second hydraulic line 14 via the second valve 46 and is drained from the first hydraulic line 13 via the first valve 45, the broom 12 will rotate in a second direction. Although the present invention is illustrated as including two valves 13 and 14, there could be any number of valves controlling the flow of fluid to and from any number of hydraulic lines 13 and 14.

A first electrical actuator 41 and a second electrical actuator 42 are operably coupled to move the first valve 45 and the second valve 46, respectively. Both valves 45 and 46 are, at least, moveable between a first position, being a low pressure position, and a second position, being a high pressure position. However, in the present invention, both valves 45 and 46 preferably include a third position, being a biased, or closed, position. Although each valve 45 and 46 is preferably a three-positioned spool valve, it should be appreciated that any type or shape of valve including any number of positions may be used in the present invention. When the first valve 45 and the second valve 46 are in the biased, or closed, position, the first hydraulic line 13 and the second hydraulic line 14 are blocked from fluid communication with the low pressure reservoir 23 and the source of high pressure 25. When the first valve 45 is in the first, or low pressure, position, the first hydraulic line 13 is fluidly connected to the first drain line 26. When the first valve 45 is in the second, or high pressure, position, the first hydraulic line 13 is blocked from communication with the first drain line 26, and preferably in fluid communication with the first supply line 28. Similarly, the second hydraulic line 14 is fluidly connected to the second drain line 27 when the second valve 46 is in the first position, and fluidly connected to the second supply line 29 when the second valve 46 is in the second position. The first hydraulic line 13 will be blocked from fluid communication with the low pressure reservoir 23 when the second hydraulic line 14 is fluidly connected with the low pressure reservoir 23, and the second hydraulic line 14 will be blocked from fluid communication with the low pressure reservoir 23 when the first hydraulic line 13 is fluidly connected with the low pressure reservoir 23. Thus, both hydraulic lines 13 and 14 will preferably not be simultaneously fluidly connected to the low pressure reservoir 23, or the source of high pressure 25.

Figure 3:
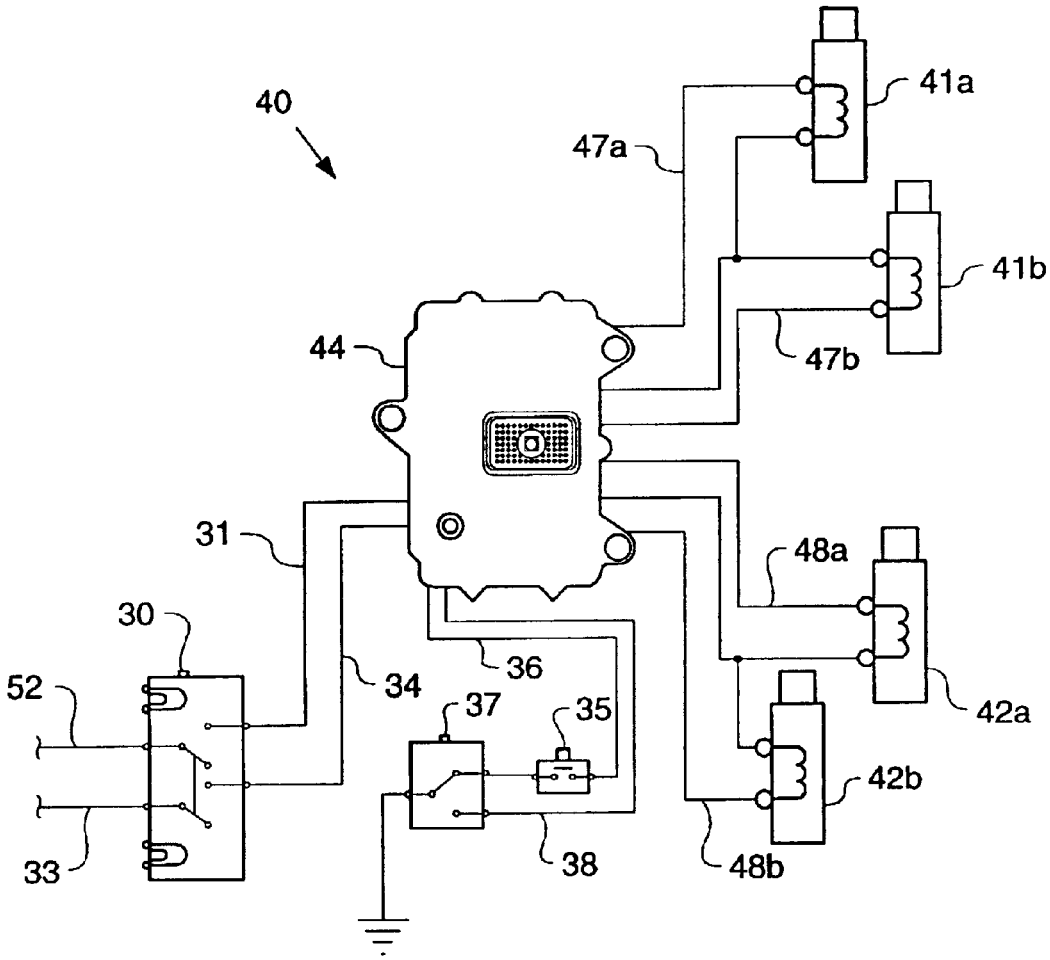
FIG. 3 is a schematic representation of a control system of the work machine of FIG. 1.

Referring to FIG. 3, there is shown a control system 40 for the work machine 10 of FIG. 1. The control system 40 includes an electronic control module 44 that is preferably in communication with the pressure release controller 30 via a controller communication line 31. An engine sensor 33, illustrated as a oil pressure sensor, is in communication with the electronic control module 44. The engine sensor 33 senses whether an engine 19 is activated and communicates such to the electronic control module 44 via the engine sensor communication line 34. Although there are various methods of sensing whether the engine 19 is activated, the engine sensor 33 is illustrated as an oil pressure sensor. At least one operator sensor is operable to sense whether the operator is occupying the operator's seat 50. In the illustrated example, there are preferably two operator sensors, being a seat sensor 35 and an arm bar sensor 37. The seat sensor 35 is operable to sense whether the operator's seat 50 is occupied and is in communication with the electronic control module 44 via the seat sensor communication line 36. The arm bar sensor 37 is operable to sense whether the arm bar 51 is in the downward position and is in communication with the electronic control module 44 via an arm bar sensor communication line 38. The arm bar sensor 37 is connected to ground.

Referring still to FIG. 3, the first electrical actuator 41 and the second electrical actuator 42 are illustrated as solenoid actuators, but could be any type of electrical actuator. Although the electrical actuators 41 and 42 could include only one solenoid coil, both electrical actuators 41 and 42 include a first solenoid 41*a*, 42*a* and a second solenoid 41*b*, 42*b*. The first solenoid 41*a* and the second solenoid 41*b* of the first electrical actuator 41 are included in a first circuit 47*a* and a second circuit 47*b*, respectively. It should be appreciated that the first circuit 47*a* and the second circuit 47*b* share a communication line from the electronic control module 44, but include separate ground lines to the electronic control module 44. For instance, in order to energize the first solenoid 41*a* without energizing the second solenoid 41*b*, the ground line of the second circuit 47*b* would be blocked from communication with the electronic control module 44. Similarly, the first solenoid 42*a* and the second solenoid 42*b* of the second electrical actuator 42 are included in a first circuit 48*a* and a second circuit 48*b*, respectively. Both circuits 48*a* and 48*b* share the same communication line, but include different ground lines. Those skilled in the art should appreciate that each circuit 47*a*, 47*b*, 48*a*, 48*b* could include its own supply line and ground line.

Each valve 45 and 46 includes a valve member that is positioned between the solenoids 41*a* and 41*b* and 42*a* and 42*b*, respectively. Each valve member is biased, preferably by springs, to the third, or closed, position, in which the first hydraulic line 13 and the second hydraulic line 14 are closed from both the source of high pressure 25 and the low pressure reservoir 23. The electronic control module 44 is programmed such that the first solenoid 41 a of the first electrical actuator 41 is simultaneously energized with the second solenoid 42*b* of the second electrical actuator 42. When the first solenoid 41*a* is energized, the first valve 41 is moved to the low pressure position, and when the second solenoid 42*b* is energized, the second valve 42 is moved to the high pressure position. The electronic control module 44 is also programmed such that the second solenoid 42*b* of the first electrical actuator 41 is simultaneously energized with the first solenoid 42*a* of second electrical actuator 42. When the second solenoid 41*a* is energized, the first valve 45 moves to the high pressure position, and when the first solenoid 42*a* is energized, the second valve 46 moves to the low pressure. Thus, the electronic control module 44 will simultaneously energize both the electrical actuators 41 and 42 to move the first valve 45 and the second valve 46 to different positions.

The electronic control module 44 includes a pressure releasing algorithm that is operable to energize the first electrical actuator 41 in order to move the first valve 45 to the first position, or the low pressure position, when the pressure release controller 30 is in the first position, and the engine sensor 33 senses the engine 19 is inactive. The pressure release algorithm is also operable to energize the second electrical actuator 42 in order to move the second valve 46 to the low pressure position, when the pressure release controller 30 is in the first position and the engine sensor 33 sense the engine 19 is inactive. Preferably, the pressure release controller 30 will be operably coupled to move the first electrical actuator 41 to the low pressure position when the pressure release controller 30 is in the first position for a first predetermined time, and will be operably coupled to move the second electrical actuator 42 to the low pressure position when the pressure release controller 30 is in the first position for a second predetermined time. The first predetermined time period and the second predetermined time period are sequential. In the illustrated example, each predetermined time period is preferably two seconds. Therefore, the time period the pressure release controller 30 will be in the first position is approximately three to five seconds. However, it should be appreciated that the first predetermined time and the second predetermined time period could be any time period in which the pressure release algorithm can be operable to release the pressure within the hydraulic lines 13 and 14. A longer time period may be desirable in order to ensure against accidental movement of the pressure release controller 30. Further, it should be appreciated that although the pressure release controller 30 is operably coupled to the valves 45 and 46 via the electronic control module 44, there may be various methods of coupling the pressure release controller 30 to the valves 45 and 46 when the engine is inactive, including but not limited to, utilization of a switch that connects a power supply to the electrical actuators 41 and 42 only when engine 19 is inactive. For safety purposes, the pressure release algorithm is enabled when the arm bar sensor 37 and the seat sensor 35 sense that the arm bar 51 is in the downward position and the operator's seat 50 is occupied. But, if at least one of the arm bar sensor 37 senses that the arm bar 51 is in the upward position and/or the seat sensor 35 determines that the operator's seat 50 is unoccupied, the pressure release algorithm is disabled. The pressure release algorithm is preferably enabled only when the engine 19 is inactive and the operator's seat 50 is occupied.

INDUSTRIAL APPLICABILITY

Referring to FIGS. 1–3, the present invention will be described for a skid steer loader 12 to which a hydraulically-driven broom 12 is attached, although the present invention contemplates use in any work machine to and from which interchangeable hydraulically-driven implements can be attached and detached. For instance, the work machine 10 could be a backhoe loader. In order to begin operating the skid steer loader 10, the operator will move the power switch 52 to the activated position. The high pressure pump 24 will begin to pump low pressure hydraulic fluid from the low pressure reservoir 23 to the source of high pressure 25. When the broom 12 is not in use, the valves 45 and 46 will be in their biased position in which the supply lines 28 and 29 and the drain lines 26 and 27 are blocked from fluid communication with the hydraulic lines 13 and 14 connecting the broom 12 to the work machine body 11. When the operator desires to operate the broom 12, the operator will preferably manipulate at least one hand control located within the cab 32 in order to activate and command the broom 12 to move in a desired direction. The operator's command will be communicated to the electronic control module 44. For instance, in the illustrated example, an operator's command to rotate the broom 12 in a first direction, such as a forward direction, will be communicated to the electronic control module 44. The electronic control module 44 will send electric current through the second solenoid 41*b* of the first electrical actuator 41. The magnetic flux created by the energized solenoid 41*b* will cause the first valve 45 to move to the high pressure position. High pressure hydraulic fluid can flow from the first supply line 28 to the first hydraulic line 13 via the first valve 45 and first attachment port 15. The electronic control module 44 will also send electric current through the first solenoid actuator 42*a* of the second electrical actuator 42, causing the second valve 42 to move to the low pressure position. Fluid flowing from the second hydraulic line 14 can drain back to the low pressure reservoir 23 via the second attachment port 16, the second valve 46, and the second drain line 27. Those skilled in the art will appreciate that, depending on material comprising the valve member and the direction of the electric current through the solenoid, the valve member can either be attracted to or repulsed from the energized solenoid. The present invention contemplates both methods of moving the valves 45 and 46 between positions.

Because the first valve 45 is in the high pressure position fluidly connecting the first supply line 28 with the first hydraulic line 13, the hydraulic fluid can flow into the hydraulically driven broom 12 through the first valve 45 and act on the mechanical device 20 in order to rotate the broom 12 in a forward direction. Those skilled in the art should appreciate that the mechanical device 20 could be any device that will use the energy created by the hydraulic fluid to rotate the broom 12. Once the hydraulic fluid performs work within the broom 12, the fluid will flow through the second hydraulic line 14 and the second valve 46. Because the second valve 46 is in the low pressure position fluidly connecting the second hydraulic line 14 to the second drain line 27, fluid will drain back to the low pressure reservoir 23 in order to be re-cycled though the hydraulic system 22.

When the operator commands the broom 12 to rotate in a second direction, or in a reverse direction, the command will be communicated to the electronic control module 44. The electronic control module 44 will send electric current through the first solenoid 41*a* of the first electrical actuator 45, causing the valve 45 to move to the low pressure position. Simultaneously, the electronic control module 44 will send electric current through the second solenoid 42*b* of the second electrical actuator 42, causing the second valve 46 to move to the high pressure position. The high pressure hydraulic fluid can then flow from the source of high pressure 25, to the second supply passage 29, through the second valve 46 and second attachment port 16 to the second hydraulic line 14. The fluid will act on the mechanical device 20 and rotate the broom 12 in the opposite direction than it did when the fluid was flowing from the first hydraulic line 13 to the second hydraulic line 14. Once the fluid performs work within the broom 12, it will flow through the first hydraulic line 13 to the low pressure reservoir 23 via the first attachment port 15, the first valve 45 and the first drain line 26.

When the operator has completed operation of the broom 12, the operator deactivates the broom 12, again preferably by manipulating at least one hand control within the cab 32. The command is communicated to the electronic control module 44 that will then cease sending electric current to both the first electrical actuator 41 and the second electrical actuator 42. Because none of the solenoids 41*a*, 41*b*, 42*a* and 42*b* are being energized, the first valve 45 and the second valve 46 will move to the biased position, in which the hydraulic lines 13 and 14 are closed from fluid communication with the low pressure reservoir 23 and the source of high pressure 25. Depending on the direction the broom 12 was being operated when the valves 45 and 46 were moved to the closed position, high pressure maybe trapped in at least one of the hydraulic lines 13 or 14. For instance, in the illustrated example, if the operator was operating the broom 12 in the forward direction, high pressure hydraulic fluid may have been flowing into the first hydraulic line 13 when the broom 12 was de-activated. When the valves 45 and 46 were closed, the high pressure hydraulic fluid may have been trapped within the first hydraulic line 13 between the first valve 45 and the mechanical device 20. Further, there may be hydraulic fluid remaining in the second hydraulic line 14 that was not pushed through the second valve 46 prior to the closing of the second valve 46.

When the operator desires to change the implement attached to the skid steer loader 10, the operator will de-activate the skid steer loader 12 in order to disengage the broom 12 from the work machine body 11 and attach a different hydraulically-driven implement. In order to detach the broom 12, the operator will manually separate the first hydraulic line 13 and the second hydraulic line 14 from the first attachment port 15 and the second attachment port 16 by disconnecting the first quick disconnector 17 and the second quick disconnector 18, respectively. Regardless of the direction in which the high pressure hydraulic fluid was moving when the broom 12 was de-activated, the trapped pressure within the hydraulic lines 13 and 14 can cause difficulty in manually separating the quick disconnectors 17 and 18. It should be appreciated that the extent of the pressure within the hydraulic lines 13 and 14 varies depending on different factors, including but not limited to, the time lapse between the de-activation of the broom 12 and the detachment of the broom 12 from the work machine body 11. The pressure within at least one of the hydraulic lines 13 and 14 may be sufficiently high such that the operator might employ undesirable methods of separating the quick disconnectors 17 and 18, such as prying apart the disconnectors 17 and 18 with work tools.

According to the present invention, the pressure within at least one of the hydraulic lines 13 and 14 extending between the work machine body 11 and the broom 12 can be relieved, at least in part, by energizing the electronically-controlled valves 45 and 46 while the engine 19 of the skid steer loader 10 is inactive. In order to energize the valves 45 and 46, the operator moves the pressure release controller 30 to the first position. The engine sensor 33 senses whether the engine 19 is active and communicates such to the electronic control module 44 via the engine sensor communication line 34. If the electronic control module 44 determines that the engine 19 is active, the pressure release controller 30 is disabled and inoperable to energize the valves 45 and 46. However, if the electronic control module 44 determines that the engine 19 is inactive, the movement of the pressure release controller 30 is communicated to the electronic control module 44 via the controller communication line 31. The seat sensor 35 will sense whether the operator's seat 50 is occupied and communicate the data to the electronic control module 44 via the seat sensor communication line 36. The arm bar sensor 37 will sense whether the arm bar 51 is in the downward position and communicate the data to the electronic control module 44 via the arm bar sensor line 38. If the electronic control module 44 determines that operator's seat 50 is occupied and that the arm bar 51 is in the downward position, the pressure release algorithm of the electronic control module 44 will be enabled. Those skilled in the art should appreciate that the operator sensors are features to ensure that the operator is in a safe position away from the broom 12 when the pressure is relieved from at least one of the hydraulic lines 13 and 14, and that the present invention contemplates a control system without operator sensors, or with varying types of operator sensors.

Once enabled, if the pressure release algorithm included within the electronic control module 44 determines that the pressure release controller 30 is in the first position for the first predetermined time period, the pressure release algorithm will be operable to energize the first electrical actuator 41 operably coupled to the first valve 45. Although the first predetermined time is illustrated as approximately two seconds, the predetermined time could be any time sufficient to relieve the pressure and drain any remaining hydraulic fluid from the first hydraulic line 13. In addition, the time delay can prevent accidental activation of the pressure release algorithm. The electronic control module 44 will send electric current through the first solenoid 41*a* via the first circuit 47*a*. The magnetic flux created by the energized first solenoid 41*a* will cause the first valve 45 to move to the low pressure position, fluidly connecting the first hydraulic line 13 to the low pressure reservoir 23 via the first drain line 26. Because the electronic control module 44 is programmed such that the first valve 45 and the second valve 46 are not fluidly connected to the low pressure reservoir 23 simultaneously, the electronic control module 44 will energize the second electrical actuator 42 such that the second valve 46 moves to the high pressure position during the first predetermined time period. Although the engine 19 is inactive, causing the high pressure pump 24 to cease pressurizing fluid, any remaining high pressure fluid in the second supply line 14 may create a sufficient pressure differential between the first hydraulic line 13 and the second hydraulic line 14 to help push any remaining hydraulic fluid from the first hydraulic line 13. Thus, by fluidly connecting the first hydraulic line 13 to the first drain line 26, pressure within the first hydraulic line 13 is relieved, and by simultaneously fluidly connecting the second hydraulic line 14 to the second supply line 29, a pressure differential within the hydraulic lines 13 and 14 may eliminate some of the remaining hydraulic fluid from the first hydraulic line 13.

The operator should maintain the pressure release controller 30 in the first position for the second predetermined period of time, which is sequential to the first predetermined period of time. Like the first predetermined period of time, the second predetermined period of time is preferably approximately two seconds, but could any time period sufficient to release the pressure from the second hydraulic line 14. When the pressure release controller 30 is in the first position for the second predetermined time period and the engine sensor 33 senses that the engine 19 is inactive, the pressure release algorithm is operable to energize the second electrical actuator 42. The electronic control module 44 will energize the first solenoid 42*a* of the second electrical actuator 42 in order to move the second valve 46 to the low pressure position, fluidly connecting the second hydraulic line 14 to the low pressure reservoir 23 via the second drain line 29. Simultaneously, the electric control module 44 will energize the second solenoid 41*b* of the first electrical actuator 41 in order to move the first valve 45 to the high pressure position, fluidly connecting the source of high pressure 25 to the first hydraulic line 14. The remaining high pressure fluid within the first supply line 28 flowing into the first hydraulic line 13 may create a pressure differential that will help push some of the remaining fluid from the second hydraulic line 14. Thus, by fluidly connecting the second hydraulic line 14 to the second drain line 27, pressure within the second hydraulic line 14 is relieved, and by simultaneously fluidly connecting the first hydraulic line 13 to the first supply line 28, a pressure differential within the hydraulic lines 13 and 14 may eliminate some of the remaining hydraulic fluid from the second hydraulic line 14.

When the second predetermined time period is completed, the electronic control module 44 will cease energizing the solenoids 41*b* and 42*a*, causing the first valve 45 and the second valve 46 to return to the closed, biased position. It should be appreciated that if the electronic control module 44 loses power prior to both hydraulic lines 13 and 14 being relieved of pressure, the operator can again move the pressure release controller 30 to the first position, causing the pressure release algorithm to again become operable to energize the first electrical actuator 41. Once the operator has held the pressure release controller for approximately 3–5 seconds allowing the pressure release algorithm to relieve pressure within the hydraulic lines 13 and 14, the operator may disengage the broom 12 from the work machine body 11 by separating the disconnectors 17 and 18. Because the pressure has been relieved within the hydraulic lines 13 and 14, the operator will be able to separate the quick disconnectors 17 and 18 with minimal effort. Moreover, because some of the remaining hydraulic fluid has been drained from the hydraulic lines 13 and 14, the amount of hydraulic fluid remaining within detached hydraulic lines 13 and 14 is reduced. It should be appreciated that the present invention contemplates relieving the pressure within the hydraulic lines 13 and 14 by fluidly connecting one of the hydraulic lines 13 or 14 to the low pressure reservoir 23 without simultaneously connecting the other hydraulic line 13 or 14 to the source of high pressure 25. Further, the present invention contemplates simultaneously fluidly connecting both hydraulic lines 13 and 14 to low pressure. Although these methods would relieve some of the pressure within the hydraulic lines 13 and 14, it may not substantially reduce the amount of hydraulic fluid trapped within the hydraulic lines 13 and 14.

The present invention is advantageous because it can relieve the pressure within hydraulic lines 13 and 14 extending between the hydraulically-driven implement 12 to the work machine 10 without substantially increasing the amount of work machine components. The present invention relieves pressure by energizing the electrical actuators 41 and 42 operably coupled to already-existing valves 45 and 46. The valves 45 and 46 have been included in the work machine 10 in order to control the movement of the hydraulically-driven implement 12 when the engine 19 is active. Rather than including additional valves, supply lines, and drain lines, the present invention uses the valves 45 and 46 to perform a second function, relieving pressure by evacuating hydraulic fluid from the hydraulic lines 13 and 14 when the engine 19 is inactive. By using existing components, the present invention may increase the system's robustness and reduce manufacturing costs. However, it should be appreciated that the present invention contemplates a work machine in which the valves relieving the pressure within the hydraulic lines when the engine is inactive are separate from the valves that control the flow of hydraulic fluid to and from the implement when the engine is active. In addition, the present invention is advantageous because it requires the operator to occupy the operator's seat 50 when the pressure release algorithm is operable to relieve the pressure from the hydraulic lines 13 and 14. Thus, if the elimination of the pressure and the remaining hydraulic fluid causes the implement 12 to move abruptly, the operator is not positioned within range of the moving implement 12. Lastly, because the pressure within the hydraulic lines 13 and 14 is reduced, or eliminated, the operator will be able to separate the quick disconnectors 17 and 18 with minimal effort. Thus, the situations in which the operator may resort to the use of tools to pry apart the disconnectors 17 and 18 is reduced, thereby reducing any destruction to the work machine 10 or implement 12 caused by the improper disconnecting methods.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A work machine comprising:

a hydraulically-driven implement fluidly coupled to a work machine body via at least one hydraulic line;

at least one valve operably coupled to an electrical actuator and being moveable between a first position and a second position; when the valve is in the first position, the at least one hydraulic line is fluidly connected to a low pressure line; when the valve is in the second position, the at least one hydraulic line is closed to the low pressure line;

an electronic control module operably coupled to the electrical actuator; and a pressure release controller being operably coupled to the electronic control module;

wherein the electronic control module energizes the electrical actuator and move the valve to the first position when the pressure release controller is in a first position and an engine of the work machine is inactive and allowing the at least one hydraulic line to be disconnected from the hydraulically-driven implement, thereby fluidly uncoupling the hydraulically-driven implement from the work machine body.

2. The work machine of claim 1 wherein the pressure release controller is operably coupled to the at least one valve via an electronic control module.

3. The work machine of claim 1 wherein the valve being a first valve and the hydraulic line being a first hydraulic line;

a second valve operably coupled to a second electrical actuator and being moveable between a first position and a second position; when the second valve is in the first position, a second hydraulic line is fluidly connected to the low pressure line; and when the second valve is in the second position, the second hydraulic line is closed from fluid communication with the low pressure line; and the pressure release controller being operably coupled to energize the second electrical actuator to move the second valve to the first position when the pressure release controller is in the first position and the engine is inactive and allowing the at least one hydraulic line to be disconnected from the hydraulically-driven implement, thereby fluidly uncoupling the hydraulically-driven implement from the work machine body.

4. The work machine of claim 3 wherein the first hydraulic line is blocked from fluid communication with the low pressure line when the second hydraulic line is in fluid communication with the low pressure line; and the second hydraulic line is blocked from fluid communication with the low pressure line when the first hydraulic line is in fluid communication with the low pressure line.

5. The work machine of claim 3 wherein the first valve and the second valve each include a third position; and when the first valve is in the third position, the first hydraulic line is blocked from fluid communication with the low pressure line and a high pressure line; and when the second valve is in the third position, the second hydraulic line is blocked from fluid communication with the low pressure line and the high pressure line.

6. The work machine of claim 5 including a high pressure line;

the high pressure line being in fluid communication with the first hydraulic line when the first valve is in the second position; and the high pressure line being in fluid communication with the second hydraulic line when the second valve is in the second position.

7. The work machine of claim 1 wherein the pressure release controller being positioned in a cab of the work machine.

8. The work machine of claim 7 including at least one operator sensor being operable to sense whether an operator's seat is occupied and being in communication with the electronic control module;

the at least one operator sensor includes at least one of a seat sensor and an arm bar sensor; and when the at least one operator sensor senses the operator's seat is occupied, the pressure release controller is enabled.

9. The work machine of claim 1 wherein the work machine is a skid steer loader.

10. The work machine of claim 6 wherein the pressure release controller is operably coupled to the first valve and the second valve via an electronic control module;

the first hydraulic line being blocked from fluid communication with the low pressure line when the second hydraulic line is in fluid communication with the low pressure line; and the second hydraulic line being blocked from fluid communication with the low pressure line when the first hydraulic line is in fluid communication with the low pressure line;

the pressure release controller is positioned in a cab of the work machine being a skid steer loader; and when at least one operator sensor being in communication with the electronic control module senses that the operator's seat is occupied, the pressure release controller is enabled.

11. A control system for a work machine with an engine comprising:

at least one valve operably coupled to an electrical actuator and being moveable between a first position and a second position;

a pressure release controller being operably coupled to energize the electrical actuator and move the valve to the first position when the engine is inactive; and an electric control module in communication with the pressure release controller;

wherein the electronic control module includes a pressure releasing algorithm being operable to energize the electrical actuator to move the valve to the first position when the pressure release controller is in the first position for a first predetermined time period.

12. The control system of claim 11 wherein the valve being a first valve;

a second valve being operably coupled to a second electrical actuator and being in communication with the pressure release controller via the electronic control module; and the pressure release controller being operably coupled to energize the second electrical actuator and move the second valve to a first position when the engine is inactive.

13. The control system of claim 12 including an engine sensor being in communication with the electronic control module.

14. The control system of claim 13 wherein the electronic control module includes a pressure releasing algorithm being operable to energize the first electrical actuator to move the first valve to the first position when the pressure release controller is in the first position for a first predetermined time period and the engine sensor senses the engine is inactive; and the pressure releasing algorithm being operable to energize the second electrical actuator to move the second valve to the first position when the pressure release controller is in the first position for a second predetermined time period and the engine sensor senses the engine is inactive.

15. The control system of claim 14 including at least one operator sensor being operable to sense whether operator's seat is occupied and being in communication with the electronic control module;

the at least one operator sensor including at least one of a seat sensor and an arm bar sensor, and when the at least one operator sensor senses that the operator's seat is occupied, the pressure release algorithm is enabled.

16. A method of fluidly disengaging a hydraulically-driven implement from a work machine body, comprising the step of:

energizing at least one electronically controlled valve while an engine of the work machine is inactive to relieve pressure in a first hydraulic line and a second hydraulic line extending between the work machine and the hydraulically-driven implement;

sequentially connecting the first hydraulic line and the second hydraulic line to a low pressure line, at least in part, by energizing the electronically controlled valve; and disconnecting the at least one hydraulic line from the hydraulically-driven implement, thereby fluidly disengaging the hydraulically-driven implement from the work machine body.

17. The method of claim 16 wherein the step of energizing includes a step of moving a pressure release controller to a first position while the engine is inactive.

18. The method of claim 17 wherein the step of energizing includes steps of occupying an operator's seat and moving an arm bar to lowered position.

19. The method of claim 16 wherein the step of energizing the electronically controlled valve being a first electronically controlled valve and a second electronically controlled valve.

* * * * *